US010953959B2

(12) United States Patent
Bossen

(10) Patent No.: US 10,953,959 B2
(45) Date of Patent: Mar. 23, 2021

(54) CARRY SYSTEM FOR PERSONAL WATERCRAFT

(71) Applicant: Robert Bossen, St Anthony Village, MN (US)

(72) Inventor: Robert Bossen, St Anthony Village, MN (US)

( * ) Notice: Subject to any disclaimer, the term of this patent is extended or adjusted under 35 U.S.C. 154(b) by 43 days.

(21) Appl. No.: 16/501,470

(22) Filed: Sep. 5, 2019

(65) Prior Publication Data

US 2020/0207450 A1 Jul. 2, 2020

Related U.S. Application Data

(60) Provisional application No. 62/728,110, filed on Sep. 7, 2018.

(51) Int. Cl.

| | |
|---|---|
| ***B63B 32/87*** | (2020.01) |
| ***B63B 32/40*** | (2020.01) |
| ***B63B 32/80*** | (2020.01) |
| ***B63B 32/70*** | (2020.01) |
| ***B63B 29/06*** | (2006.01) |
| ***B63B 29/04*** | (2006.01) |

(52) U.S. Cl.

CPC ..... *B63B 32/87* (2020.02); *B63B 29/06* (2013.01); *B63B 32/40* (2020.02); *B63B 32/70* (2020.02); *B63B 32/80* (2020.02); *B63B 2029/043* (2013.01)

(58) Field of Classification Search

CPC ..... B63B 32/00; B63B 32/40; B63B 32/70; B63B 32/77; B63B 32/80; B63B 32/83; B63B 32/87; B63B 34/26; B63B 29/04; B63B 2029/043; B63B 29/06; A47C 1/0352

See application file for complete search history.

(56) References Cited

U.S. PATENT DOCUMENTS

| | | | | | |
|---|---|---|---|---|---|
| 4,236,267 | A * | 12/1980 | Lewis | B63B 17/00 | 114/347 |
| 4,310,169 | A * | 1/1982 | Brough | A63C 5/03 | 280/14.1 |
| 4,357,894 | A * | 11/1982 | Kirk | B63H 16/02 | 114/347 |
| 4,649,846 | A * | 3/1987 | Javanelle | B63B 32/80 | 224/181 |
| 4,768,459 | A * | 9/1988 | Cerkvenik | A45F 3/15 | 114/363 |
| 4,873,935 | A * | 10/1989 | Lustig | B63B 29/04 | 114/347 |
| 5,433,510 | A * | 7/1995 | Pestel | B63B 7/085 | 248/429 |
| 8,590,478 | B2 * | 11/2013 | Lipman | B63B 32/00 | 114/363 |
| 10,173,756 | B2 * | 1/2019 | Little | B63B 32/70 | |
| 10,494,066 | B1 * | 12/2019 | Garcia | B63B 29/04 | |

* cited by examiner

*Primary Examiner* — Ajay Vasudeva

(57) ABSTRACT

Carry system for personal watercraft is disclosed. In one example, the carry system is used to carry a personal watercraft overhead. In another example, the carry system is used as a seat for the rider of the personal watercraft.

4 Claims, 6 Drawing Sheets

CARRY SYSTEM FOR PERSONAL WATERCRAFT

RELATED APPLICATIONS

This application claims priority to U.S. Provisional Patent Application Ser. No. 62/728,110, the entirety of which is incorporated by reference herein.

BACKGROUND

The use of personal watercraft has become a popular recreational activity. Although some paddle board transport systems have been developed for this purpose, many systems are prone to failure. As such, improvements are desired.

SUMMARY

Carry System for Personal Watercraft are disclosed. In some uses, it is desirable for a user of personal watercraft to be able to more easily transport the watercraft over longer distances on land. For example, if a user is in a remote area with other gear, the ability to easily transport the watercraft between bodies of water is of benefit. Additionally, if the user needs to transport the watercraft from their vehicle to a body of water that is a distance away, a carry system that allows the rider to more easily transport the watercraft is desirable. In one example, carry system for personal watercraft is used to carry the watercraft over-head. In other examples, the carry system for personal watercraft is used in the sitting position as a seat. In yet another example, the track is showing how the carry system can be moved from one position on the watercraft to be used for carrying the watercraft overhead and slid backward toward the tail of the watercraft for use in a sitting position.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The accompanying drawings, which are incorporated in and constitute a part of the description, illustrate several aspects of the present disclosure. The personal watercraft embodiment depicted in the description is a stand up paddle board. A brief description of the drawings is as follows.

DETAILED DESCRIPTION

Figure 1:
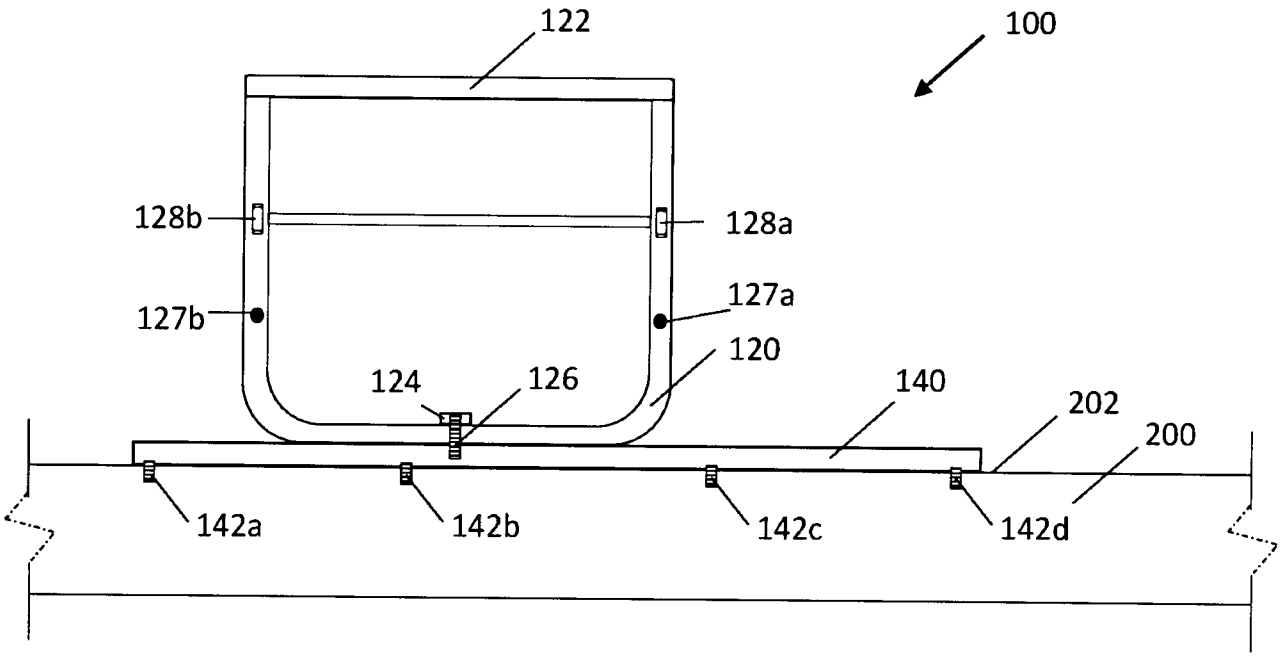
FIG. 1 is a schematic cross-section view of a first embodiment of a carry system attached to a stand up paddle board and the track system which allows the carry system to move fore and aft on the paddle board.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Figure 2:
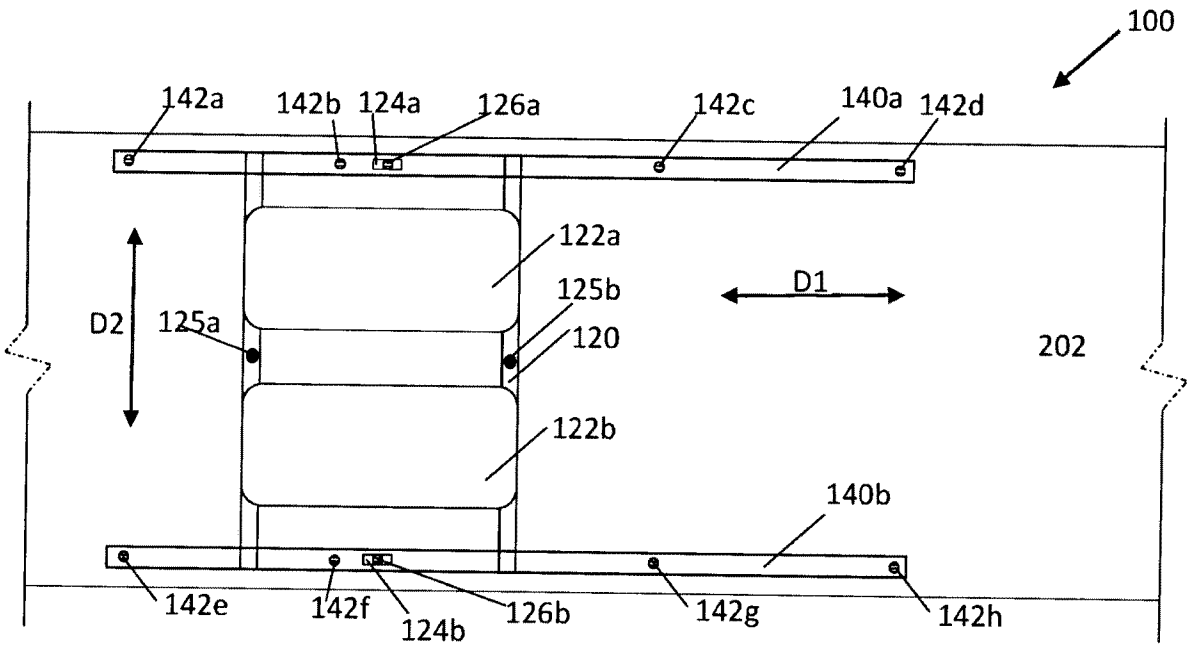
FIG. 2 is a schematic top view of the carry system shown in FIG. 1.
Figure 2B:
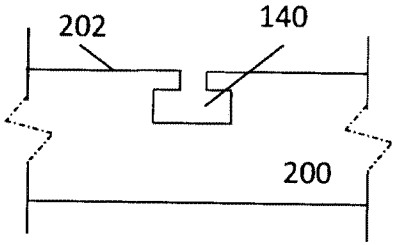
FIG. 2*b* is schematic cross section view of the track system shown in FIG. 1 with track system molded into the personal watercraft.
Figure 2A:
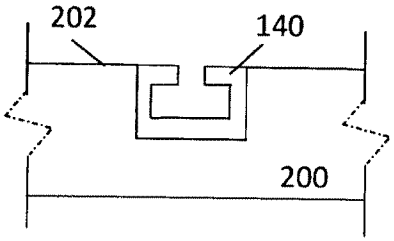
FIG. 2*a* is a schematic cross section view of the track system shown in FIG. 1 with track system recessed into personal watercraft.
Figure 3:
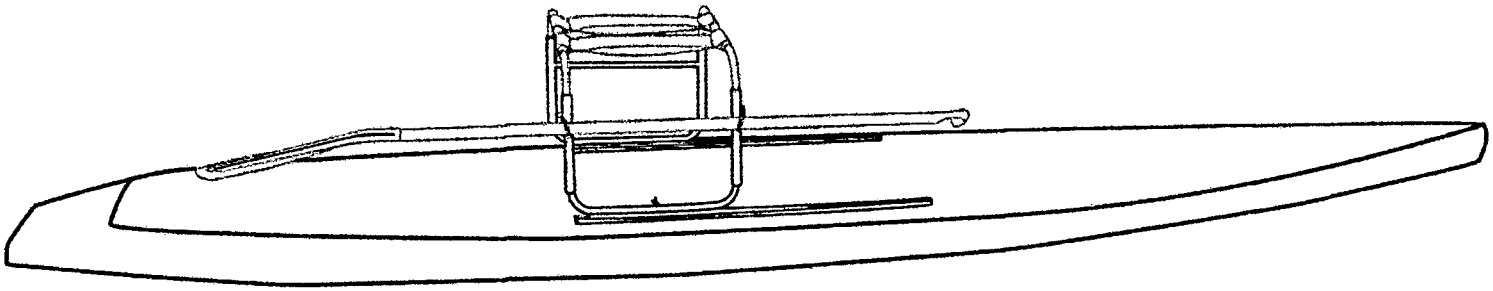
FIG. 3 is a perspective view of the carry system shown in FIG. 1.
Figure 6:
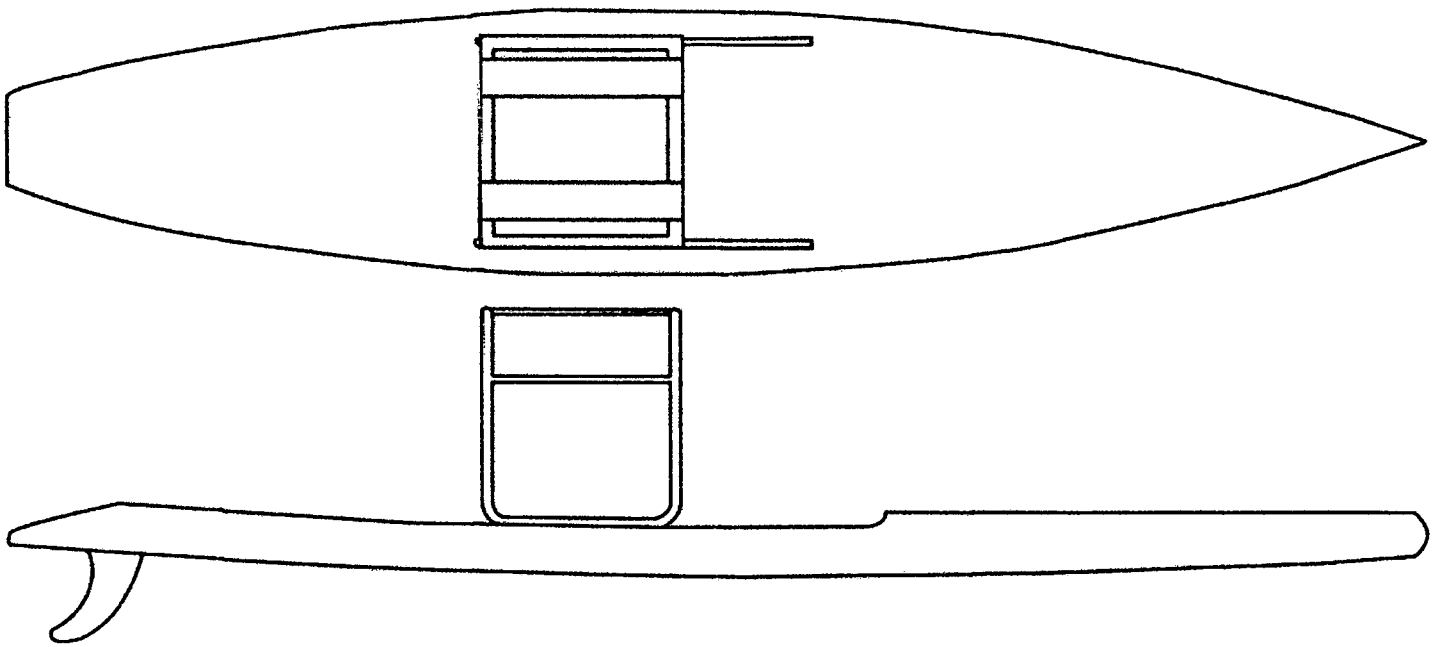
FIG. 6 is a schematic and top and side view of the stand up paddle board shown in FIG. 1 with carry system attached therein.

Referring to FIG. 1, a carry system 100 for a personal watercraft 200 having a top surface 202 is shown. The personal watercraft may be a solid structure (e.g. foam core with fiberglass/carbon epoxy outer skin), hollow rigid structure (e.g. a carbon fiber and epoxy shell), molded plastic, or inflatable. One example of a personal watercraft 200 is shown at FIG. 6, embodied as a stand up paddle board. The carry system 100 includes but is not limited to features described as follows: A carriage 120 that supports the weight of the watercraft when used overhead, or a rider when used as a seat. Padded shoulder rests/seat bottom 122, comprised of a soft core such as foam, with durable out later such as woven nylon or polyester. Gear loops 128 to secure paddle, fishing rods, or other items to carriage 120 in either the overhead or seated position. Adjustment mechanism 126 to move and secure carriage 120, at infinite number of positions, to track 140. Fastener 124 to secure carriage to Adjustment mechanism 126. Width adjustment mechanism 125 to allow width of carry system to be adjusted to watercraft. Height adjustment mechanism 127 to allow seat height to be adjusted of carry system. The carry system 100 also includes track 140 which may be permanently secured to the personal watercraft, as shown in FIGS. 1, 2 and 6. The track 140 forms a secure base for the carriage 120. In one example, the personal watercraft is a solid structure which the track 140 can be attached. In such a case, the track 140 can be secured to the board either mechanically 142 or with an adhesive, such as an epoxy or 3M VHB tape. The track 140 may also be molded into the structure of the watercraft as shown in FIG. 2*b* or recessed into the top of the watercraft as shown in FIG. 2*a*. The track 140 may be of rigid construction and made of hard materials such as metal or plastic, or flexible construction made of polymeric material.

The carry system 100 can be used in a variety of ways, including, but not limited to, carrying the personal watercraft overhead or in a seated position while on the water. The carriage 120 can be moved fore and aft parallel to the longitudinal axis of the watercraft D1 along the track 140 depending on intended use. When used for overhead carrying, the carriage 120 is moved to a position along the track 140 that allows the board to be balanced, bow to stern. The padded shoulder rests/seat bottom 122 then rest on the shoulders of the person carrying the watercraft when used for transporting the watercraft by foot. When the carry system 100 is used for seating, the carriage 120 is moved toward the stern of the watercraft along the track 140. This is accomplished by loosening the fastener 124 from Adjustment mechanism 126, allowing carriage 120 to slide toward stern of the watercraft. Once the carriage 120 is positioned where the rider would like, the fastener 124 is tightened to Adjustment mechanism 126 that secures the carriage 120 to the track 140. The padded shoulder rests/seat bottom 122 may be adjusted directionally along axis D2 via friction to ensure a comfortable seating position for the rider. Height adjustment mechanism 127 may be used to adjust seating position height. A person utilizing the carriage 120 may want to rest their paddle, fishing pole, or other accessory. The Gear Loops 128 can be used to attach items to the carriage 120.

Figure 4:
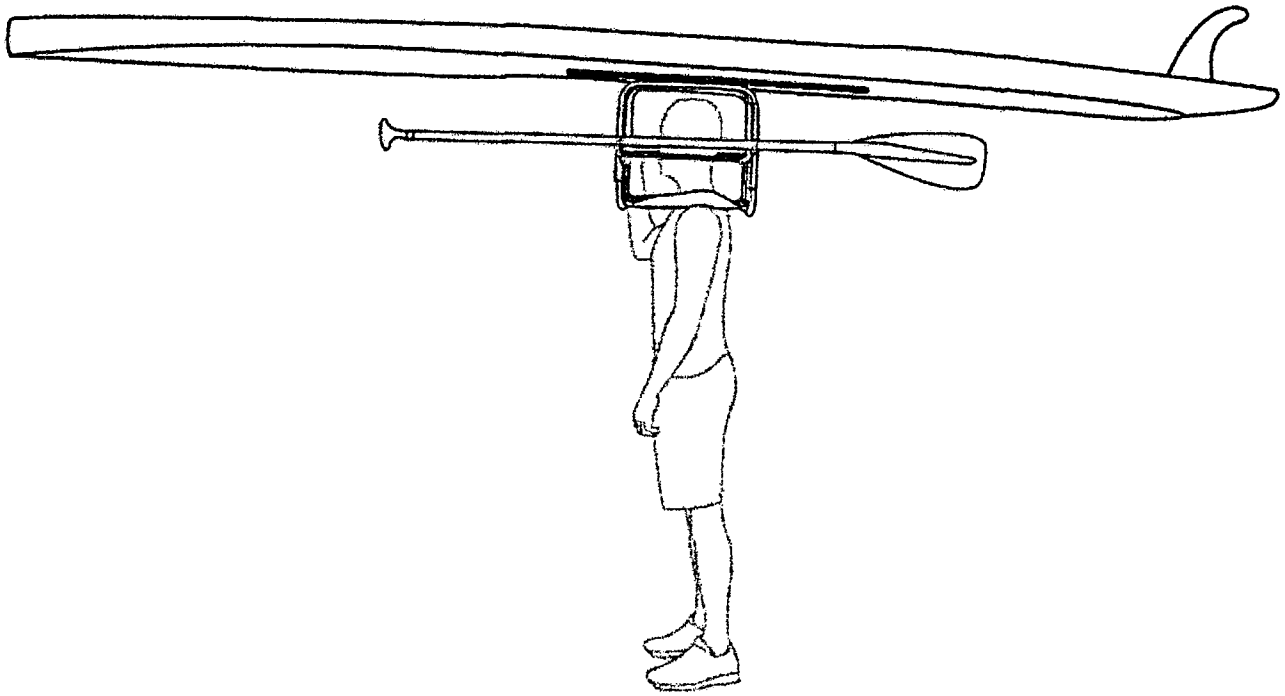
FIG. 4 is a perspective view of the carry system shown in FIG. 1 in use with paddle board being carried overhead.

Referring to FIG. 4, this view shows the carry system 100 in use in the overhead position. The carriage 120 is positioned at the weighted center of the personal watercraft for balance bow to stern, and secured to track 140 by the combination of Adjustment mechanism 126 and fastener 124. The Gear Loops 128 are in use to secure the paddle to the carriage 120. Padded shoulder rests/seat bottom 122 rest on the shoulder of the user.

Figure 5:
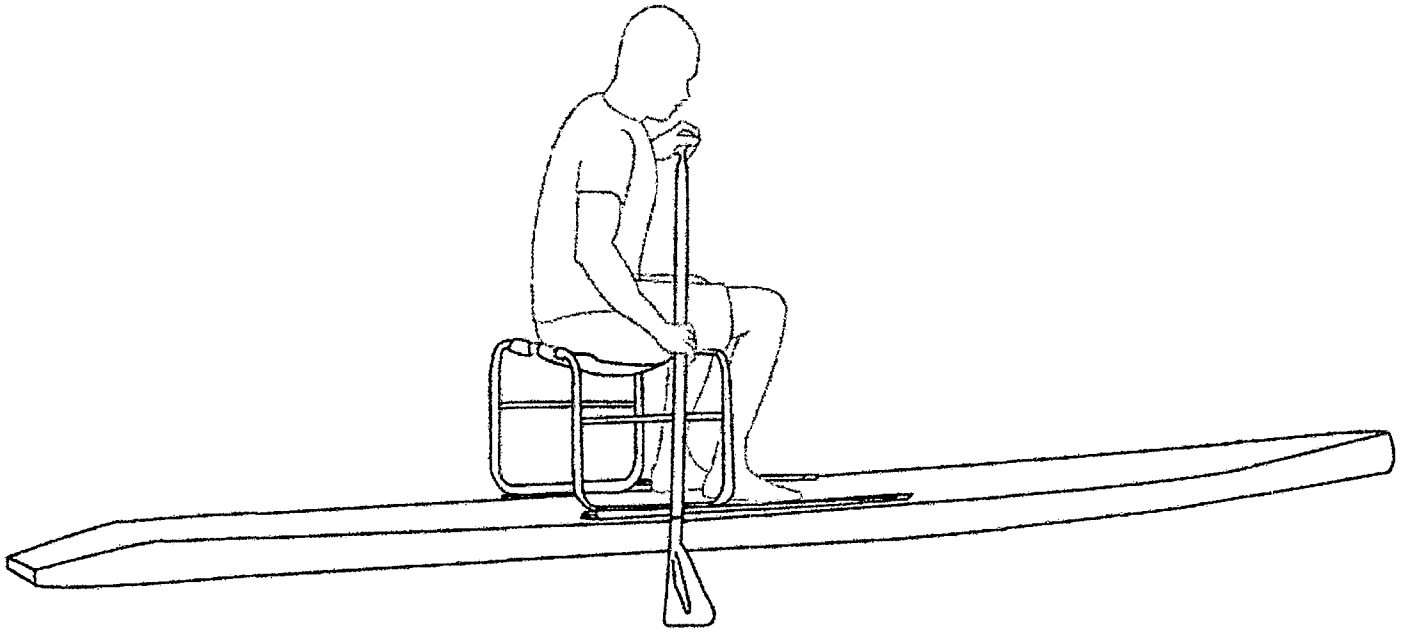
FIG. 5 is a perspective view of the carry system shown in FIG. 1 in seating position use with paddle board.

Referring to FIG. 5, this view shows the carry system 100 in use in the seating position. The carriage 120 is positioned toward the stern of the personal watercraft to allow rider standing area at the center area between bow to stern. The carriage 120 is secured to track 140 in this position by the combination of Adjustment mechanism 126 and fastener 124. The Gear Loops 128 are in use to secure a paddle to the carriage 120. Padded shoulder rests/seat bottom 122 is used as seat in this position.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A personal watercraft, comprising:

(a) a watercraft defining a top surface, the watercraft being a stand-up paddle board; and (b) a carry system, including:

(i) a track system having a pair of tracks, the pair of tracks mounted to the top surface of or molded into the top surface of the watercraft;

(ii) a carriage, removably secured to the track system with one or more fasteners that allow the carriage to be moved fore and aft relative to the track system;

(iii) an adjustment mechanism securing the carriage in a selected fixed position relative to the track system; and (iv) a shoulder rest-seat arrangement mounted to the carriage, the shoulder rest-seat arrangement forming a seating surface for a user of the personal watercraft and forming a shoulder resting surface for the user during transport of the personal watercraft, the shoulder rest-seat arrangement including two padded straps, wherein a distance between the two padded straps can be selectively adjusted.

2. The personal watercraft of claim 1, wherein the track system is mounted mechanically or by an adhesive.

3. The personal watercraft of claim 1, further comprising a second adjustment mechanism for adjusting the height of the shoulder rest-seat arrangement.

4. The personal watercraft of claim 1, wherein the shoulder rest-seat arrangement is selectively movable between a seating position and a transporting position.

* * * * *